United States Patent [19]

Ogawa

[11] 4,246,858

[45] Jan. 27, 1981

[54] SAFETY DEVICE FOR PATTERN SELECTION IN ZIGZAG SEWING MACHINES

[75] Inventor: Masao Ogawa, Nagoya, Japan

[73] Assignee: Brother Kogyo Kabushiki Kaisha, Aichi, Japan

[21] Appl. No.: 60,052

[22] Filed: Jul. 24, 1979

[30] Foreign Application Priority Data

Aug. 11, 1978 [JP] Japan ..... 53-98404

[51] Int. Cl.[3] ..... D05B 69/22; D05B 3/02

[52] U.S. Cl. ..... 112/275; 112/158 A

[58] Field of Search ..... 112/275, 277, 158 R, 112/158 A, 158 D, 158 E, 274

[56] References Cited

U.S. PATENT DOCUMENTS 4,078,506 3/1978 Sasaki ..... 112/277 X 4,084,523 4/1978 Kasuga ..... 112/158 A 4,193,362 3/1980 Glaser ..... 112/275

*Primary Examiner*—Peter P. Nerbun

*Attorney, Agent, or Firm*—Browdy and Neimark

[57] ABSTRACT

A mechanism disposed in a sewing machine for sequentially performing, in regard to an operation of a single manually operable member while the needle being penetrated through a work fabric, shifting of a needle to a predetermined position above the work fabric due to a temporary slight rotation of the main shaft, retracting or withdrawal of a cam follower from tracking on a pattern cam, and transferring of the cam follower from one pattern cam to another. This mechanism virtually assures that during the pattern selection the needle never jogs laterally while the needle is penetrating through the work fabric, whereby the work damage and the needle breakage can surely be prevented.

11 Claims, 10 Drawing Figures

SAFETY DEVICE FOR PATTERN SELECTION IN ZIGZAG SEWING MACHINES

BACKGROUND OF THE INVENTION

This invention relates to a safety device for pattern selection in zigzag sewing machines.

In conventional zigzag sewing machines a needle bar is likely to be oscillated or jogged in a lateral direction when a machine operator manually changes the pattern selecting operation in order to form a desired stitch pattern. The needle is, therefore, subjected to damage, when it is in a penetrated state, that is, it is passing through a needle aperture for zigzag stitching formed in the throat plate during the progress of the pattern selecting operation, because the needle is laterally jogged while it is in close abutment with the edge of the needle aperture.

One of the known devices proposed for solving the problem a cam follower, which is to move for tracking the shape of a pattern cam, is constructed such that its movement is to be transmitted to a needle bar gate by way of a link that is pivoted to the same for normally oscillating in a body with the needle bar gate under the action of a spring; and a stopper is disposed for defining the limit of the jogging of the needle bar. So the lateral shifting of the needle can be prevented, after the needle bar has been laterally shifted to abut the stopper for the pattern selecting operation, because only the link can be then rotated against the spring force. In the event of a pattern selecting operation with such a device, while the needle is in a penetrated state through a thin work fabric pressed on the throat plate by the pressure foot, the work fabric can still be subjected to a damage due to the movement of the needle before the needle bar completely contacts the stopper, because the spring force is greater than the shifting resistance acted on the needle because of existence of the work fabric.

Another further improved device is known as, for example, U.S. Pat. No. 3,820,485. In this device a separable clutch means is disposed between the needle bar and the needle reciprocating mechanism, and a clutch separating mechanism is attached thereto wherein the clutch means can be separated before a cam follower is thrown out of the cam tracking relation in response to the initial movement of a cam follower retracting mechanism. With this arrangement the needle is released from the endwise reciprocating movement mechanism and lifted free above the work fabric by a lifting spring prior to cam follower throw-out. An independent pattern cam selecting means separated from the cam follower retracting mechanism is operated for transferring the cam follower from one pattern cam to another after it has been released from the cam tracking relation. So it is necessary in this device to separately operate a manual handling of the needle elevation and the cam follower releasing as well as a pattern cam selecting operation. Further the device disclosed in the patent needs another special mechanism for making the clutch mechanism between the needle bar and the needle reciprocating mechanism engaged in response to the restarting of the sewing operation thereafter.

SUMMARY OF THE INVENTION

It is a primary object of this invention to provide a zigzag sewing machine capable of selecting a desired stitch pattern at any needle position, while avoiding needle breakage or damage to the work fabric (hereinafter simply called work), by means of a single manual operation without necessity of any specific additional operation.

The above object can be attained by means of constructing the machine such that a needle positioning device for halting the rotation of the main shaft of the machine when the needle has reached a predetermined position free above the work is operatively connected to a manually operable pattern selecting means and the needle positioning device will be operated, when the pattern selecting means is operated while the needle is in a penetrated state through the work, in relation to the initiation of the pattern selecting operation. Such a construction makes it possible that the main shaft is temporarily rotated to shift the needle free above the work during the period of pattern selection and the main shaft is later halted of its rotation when the needle has firstly reached the predetermined position above the work. Under this condition substantial pattern selecting operation is conducted.

It is therefore another object of this invention to provide a novel safety device for preventing the taking place of pattern selecting operation in a state wherein the needle is penetrated through the work.

BRIEF DESCRIPTION OF THE DRAWINGS

Drawings are for illustrating a preferred embodiment of this invention wherein.

DESCRIPTION OF THE PREFERRED EMBODIMENT

With reference to the accompanying drawings a preferred embodiment of this invention is to be described hereunder.

Figure 2:
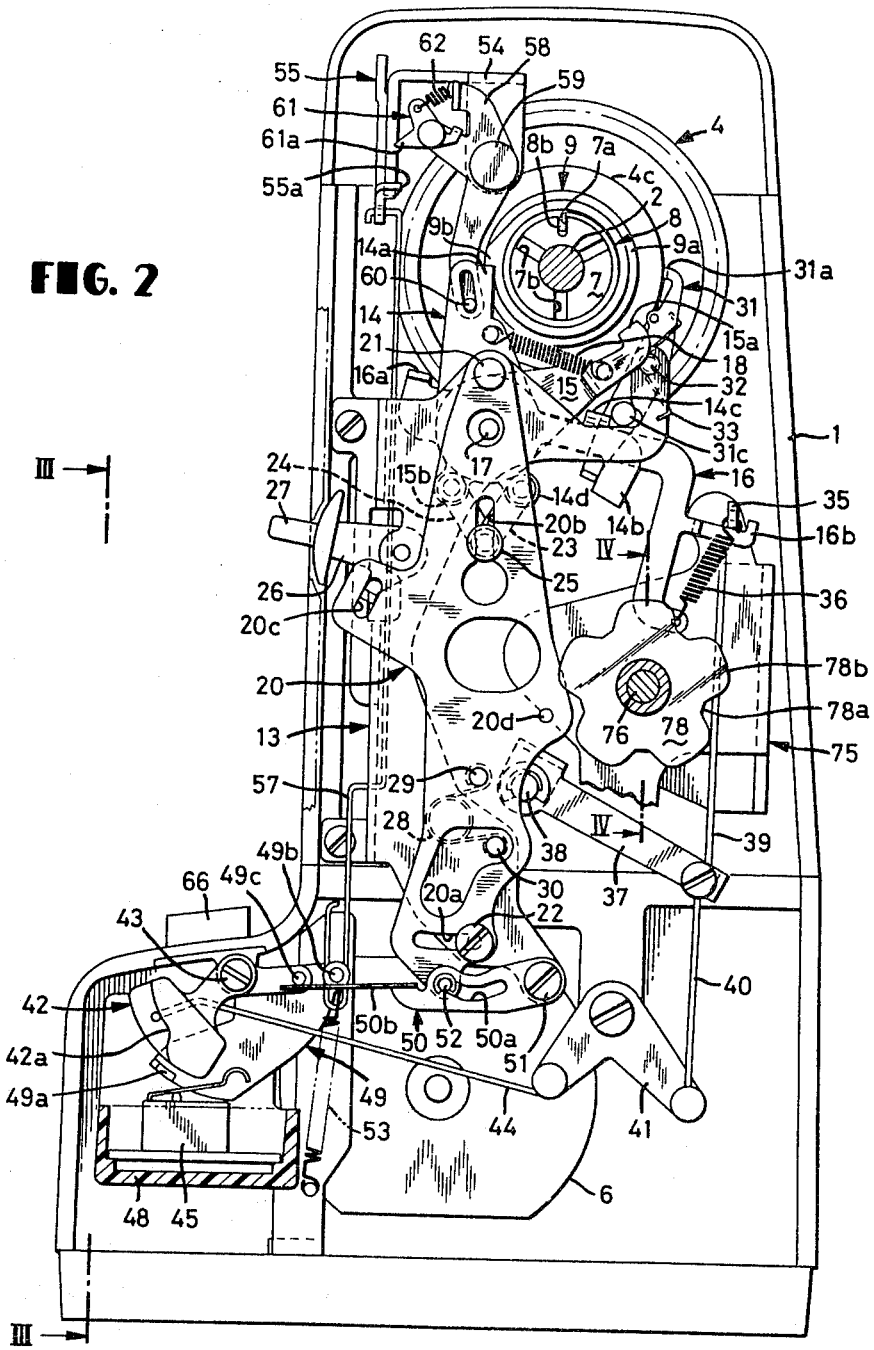
FIG. 2 is an elevational view of an essential part of an embodiment of this invention, with the side cover and the handwheel of the machine being taken away.
Figure 5:
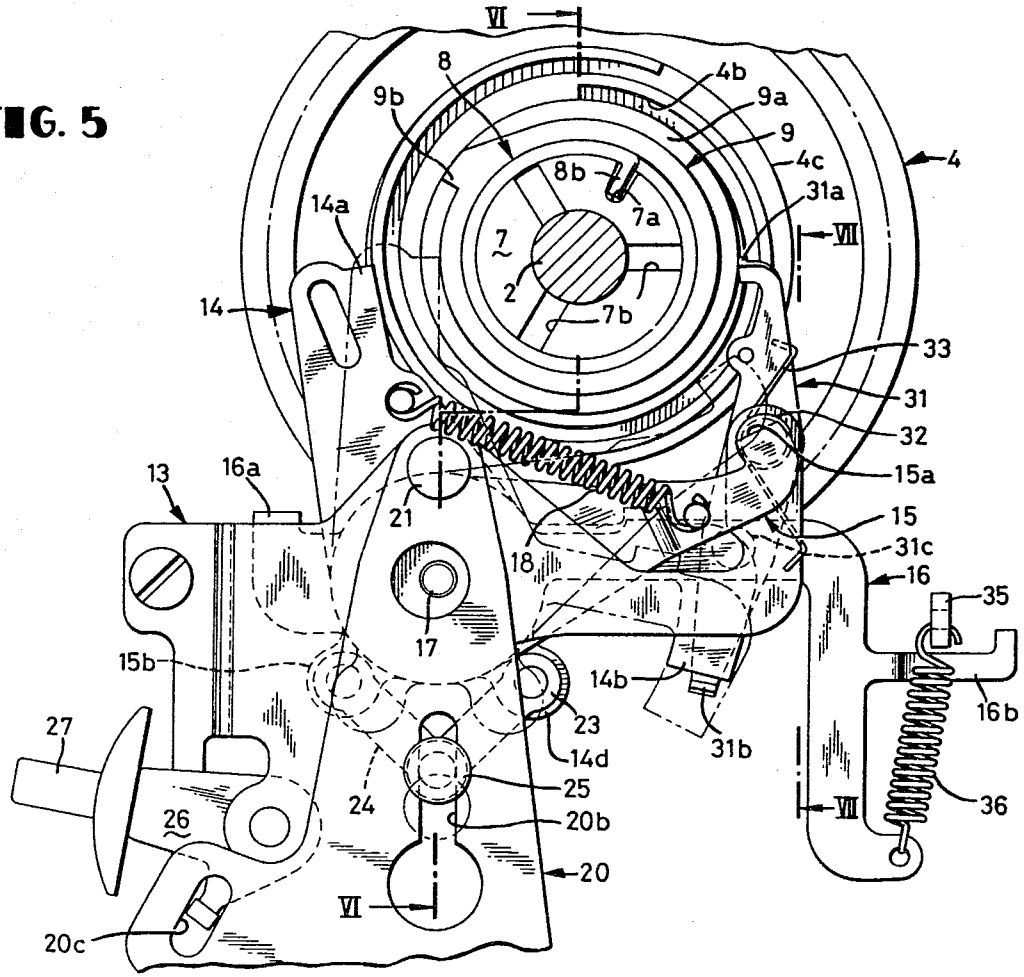
FIG. 5 is an enlarged sectional view corresponding to a part of FIG. 2 for explaining the operational mode.
Figure 6:
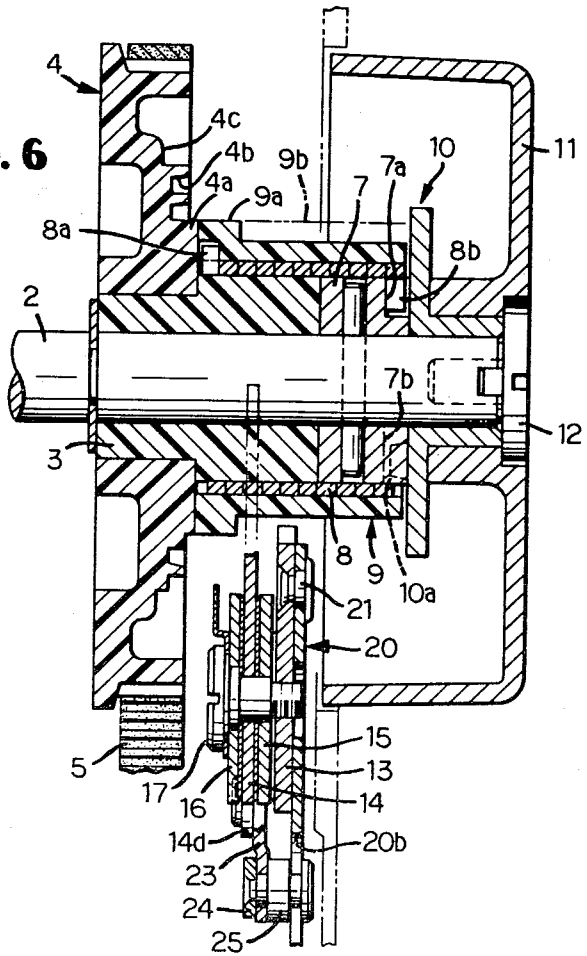
FIG. 6 is a sectional view of FIG. 5 taken substantially along the line VI—VI.

Referring to FIGS. 2, 5, and 6, on a main shaft 2 rotatably carried by a machine frame 1 a pulley 4, to which a shaft collar 3 is secured, is loosely fitted. The pulley 4 is, via a belt 5, connected to a drive motor 6 for being rotated together with the shaft collar 3 about the main shaft 2. Adjacent to the shaft collar 3 a second shaft collar 7 having the same outer diameter as the shaft collar 3 is fixedly fitted on the main shaft 2. A cylindrical spiral spring 8 is closely wound around both shaft collars 3 and 7, being anchored at one end **8*a* thereof, which is located on the side of the shaft collar 3 and radially erected there, to a rotatable member or sleeve 9 fitted around the spiral spring 8, and also anchored at the other end 8b thereof to a groove 7a formed in the second shaft collar 7. The spiral spring 8 functions as a clutch spring. The rotation of the pulley 4 is normally transmitted, via the first shaft collar 3, the spiral spring 8, and the second shaft collar 7, to the main shaft 3; when the one end 8a of the spiral spring 8 is halted, the spiral spring 8 is loosened to interrupt the transmission of the pulley rotation to the main shaft 2, with a result of allowing it to halt. On the right side of the second shaft collar 7 a flanged collar 10 is fitted on the main shaft 2; projections 10a formed on the flange portion of the flanged collar 10 are fitted in grooves 7b formed on the right side surface (see FIG. 6) of the second shaft collar 7. A handwheel 11 fitted on the flange collar 10 is closely contacted onto the flange portion with an attaching screw 12, consequently being normally rotatable together with the main shaft 2. On the right side surface of the pulley 4 (see FIG. 6) are a centrally located projecting boss portion 4a, a spiral groove 4b having its starting point at the foot, on the circumferential side, of the boss portion 4a, and an annular groove 4c formed adjacently to the end of, and deeper than, the spiral groove 4b. On the left end of the rotatable member or sleeve 9, an annular flange portion 9a having the same outer diameter as the boss portion 4a of the pulley 4 is formed, and on the right side of the annular flange portion 9a is formed an engagement portion 9b**.

On the other hand, a pair of stop levers 14, 15 and an interlocking lever 16 are respectively, with a spacer between each two neighboring members, pivoted on a support plate 13 secured to the machine frame 1 with a stepped screw 17. On one end of one stop lever 14 of the pair is disposed an abutment portion 14a engageably located with engagement portion 9b of the sleeve 9, on the other end are formed an engagement portion 14b functioning as described below and a lug or bent portion 14c engageable with the upper edge of the interlocking lever 16, and at the middle portion is formed a connecting portion 14d. On the tip of the other stop lever 15 an abutment portion 15a engageably located with the engagement portion 9b of the sleeve 9 is similarly formed and on the base portion is formed a connecting portion 15b. Between the two stop levers 14, 15 a tension spring 18 is spanned for biasing the pair of stop levers 14, 15 such that the two abutment portions 14a, 15a are moved onto the rotational locus of the engagement portion 9b of the sleeve 9. Besides, on one end of the interlocking lever 16 is formed a bent portion 16a engageable with the upper edge of the support plate 13 and on the other end a connecting portion 16b.

Positional relation between the engagement portion 9b and the stop lever 14 is so determined in this machine that the main shaft 2 can be stopped at a position where a needle bar 19 carrying a sewing needle at the lower end thereof has reached a place slightly descended from the upper dead point, that is to say, when the tip of the take-up lever (not shown) of the machine is at the highest position owing to the abutment portion 14a of the one stop lever 14 being engaged with the engagement portion 9b to make the sleeve 9 and the one end 8a of the spiral spring 8 halt. Positional relation between the engagement portion 9b and the abutment portion 15a of the stop lever 15 is likewise determined such that the main shaft 2 can be stopped when the needle bar 19 has substantially reached the lower dead point as the engagement portion 15a has been engaged with the engagement portion 9b to make the sleeve 9 and the one end 8a of the spiral spring 8 halt.

On the support plate 13 a switching arm 20 is pivotally attached with a stepped pin 21, and in a slot formed in the lower portion of the switching arm 20 the stud portion of a stepped pin 22 secured to the support plate 13 is fitted so as to define a range of the pivotal movement of the switching arm 20. In the middle portion of the switching arm 20 is formed a vertical slot 20b, wherein the stud portion of a connection pin 25 is fitted to be guided the movement thereof. The pin 25 pivots respective one end of a pair of links 23, 24 whose respective the other end is pivoted to a connecting portion 14d, 15b of the pair of stop levers 14, 15. In the middle portion of the switching arm 20 another slot 20c is formed, wherein a bent portion formed on one end of a change lever 26 pivoted to the support plate 13 is fitted. On the other end of the change lever 26 is fitted an operated knob 27, which is outwardly projecting through an opening formed in the machine frame 1. The change lever 26 makes it possible to rotate the switching arm 20 by an operation from outside the machine frame 1. Between the switching arm 20 and the support plate 13 is, as shown in FIG. 2, installed a coil spring 28, both ends of which are respectively anchored to a pin 29, 30 respectively secured to the switching arm 20 and the support plate 13, with the coiled portion being in the middle. When the change lever 26 is manually operated to a position shown in FIG. 2 the switching arm 20 is, due to the action of the coil spring 28, biased clockwise about the stepped pin 21 and the extreme right edge of the slot 20a will be kept in abutment with the stepped screw 22. And when the change lever 26 is counterclockwise rotated from the position shown in FIG. 2, the switching arm 20 is also rotated in the same direction to move the pin 29 rightwardly beyond an imaginary line linking the axis of the stepped screw 21 and that of the pin 30. The coil spring 28 biases the switching arm 20 counterclockwise, a reverse direction to the above-mentioned direction, to keep the stepped screw 22 in abutment with the extreme left edge of the slot 20c (see FIG. 9).

Furthermore, on the support plate 13 is installed an actuating lever 31 having on one end a pawl portion 31a with an attaching pin 32 in such a manner that the actuating lever 31 is rotatable about its axis and also tiltable within a plane including its axis. Due to the action of a coil spring 33 disposed around the attaching pin 32 the actuating lever 31 is biased such that the pawl portion 31a thereof tends toward the inward radial direction of the pulley 4 and at the same time approaches toward the pulley 4. Near the other end portion of the actuating lever 31 are formed a bent portion 31b (see FIG. 5), located adjacent to the engagement portion 14b of the stop lever 14 for being capable of confronting from under side with the engagement portion 14b as later described when the stop lever 14 is counterclockwise rotated, and a semi-spherical portion for being urged by the interlocking lever 16 and tilting the actuating lever 31 against the biasing force of the coil spring 33 when the lever 16 is rotated counterclockwise from the position shown in FIG. 2.

Figure 1:
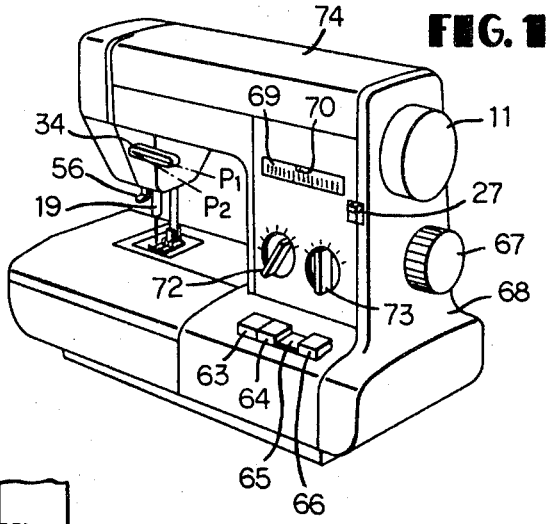
FIG. 1 is a perspective view showing the general view of a sewing machine.

With reference to FIGS. 1 and 2, it is observed that a manually operable lever 34 operable at the front side of the machine is disposed on the upper portion of the jaw of the machine. The manually operable lever 34 is rotatable, as described below, between the position P1 for halting the machine operation and the position P2 for running the machine, being so designed as to be selecting moved to either one position and maintained there. A switch lever 35 is disposed within the machine frame 1, rotatably in interlocking relation with the manually operable lever 34, and one end thereof is confronted from above to the connecting portion 16*b* of the interlocking lever 16 for making the interlocking lever 16 move together with the switch lever 35 interlockingly due to the action of a tension spring 36. As a connecting mechanism for interlocking the manually operable lever 34 and the switch lever 35 and a positioning means for the manually operable lever 34, a disclosure stated in the U.S. Pat. No. 4,078,506 by the same applicant as in the present application is applicable in this invention, details of which being omitted here because of its nonnecessity for the understanding of the present invention, and its easy accesibility.

An intermediate lever 37 is rotatably attached with a pivot 38 to the machine frame 1 and is connected through a rod 39 to the switch lever 35. The lever 37 is further connected through another rod 40 to one end of a rotatable lever 41 carried by the machine frame 1. A switch actuating cam body 42 is pivoted with a stepped screw 43 to the machine frame 1 and connected, by way of a rod 44, to the rotatable lever 41. Three switches 45–47 are disposed side by side on a switch box 48 fixed within the machine frame 1. Each of the contacting levers of the switches are respectively capable of contacting selectively with a cam surface formed on the lower side of the switch actuating cam body 42. An actuating arm 49 is mounted, with the stepped screw 43, independently rotatable from the switch actuating cam body 42. On lower side of the actuating arm 49 is formed an actuating portion 49*a* which can be contacted to the contacting lever of the switch 47, one of the three switches, and on the upper portion of which is integrally formed two projection pins 49*b*, 49*c*. On the lower portion of the support plate 13 a connection plate 50 having a substantially down curved arcuate cam slot 50*a* is rotatably attached with a stepped screw 51. A pin 52 fixed on the switching arm 20 is fitted into the cam slot 50*a*. As viewed in FIG. 2, actuating arm 49 is retained at the in position by a clockwise biasing force due to the action of a tension spring 53 spanned between the projection pin 49*b* and the frame 1 and an abutting engagement, on the other hand, of the projection pin 49*c* on a horizontal extension 50*b* of the connection plate 50.

On a bracket 54 fixed to the machine frame 1 an actuating lever 55 with bifurcated arms is rotatable mounted, one of the arms is connected, via a not shown linking mechanism, to an operable rod 56 (see FIG. 1), for being rotated by the operation of the rod 56. The actuating arm 49 is operatively connected to the other arm of the actuating lever 55, via a rod 57 whose lower end loop is fitted on the projection pin 49*b*. A support lever 58 is rotatably mounted with a pivot 59, and a pin 60 secured to the lower end of which lever 58 is fitted in an elongated slot formed in the one stop lever 14. An engagement pawl 61 is pivoted on the support lever 58, and a bent portion formed on one end of which pawl 61 is normally kept in abutment, due to the spring action of a tension spring 62, with one edge of the support lever 58; a tip of the pawl portion 61*a* is confronted from above to an engagement portion 55*a* formed on the other arm of the actuating lever 55, for being able to abut to each other.

Figure 3:
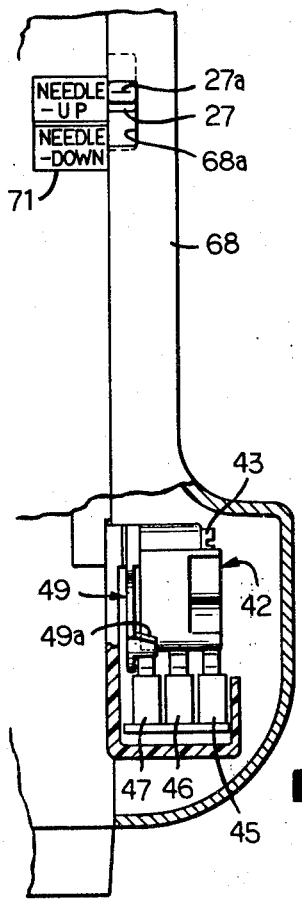
FIG. 3 is a partial sectional view of FIG. 2 taken along the line III—III.

Three push buttons 63–65 for speed setting are, with a main switch push button 66, disposed side by side on the front side of the machine standard, selective operation of those buttons 63–65 making the closing of the described below switch possible. A pattern selecting knob 67 is installed beneath the handwheel 11, being projected from the side cover 68, whose rotational operation allows the selection of a desired stitch pattern. The selected stitch pattern can be indicated by a cooperation of a pattern display panel 69 and a shiftable pointer 70. On the front surface of the operated knob 27 which is projected from an opening 68*a* of the side cover 68 an indicating line 27*a* is impressed, as can be clearly seen in FIG. 3, for showing the state of machine halting in cooperation with an indicator 71. And the numeral 72 indicates a manually operated knob for regulating an amplitude of needle oscillation, 73 indicates another manually operated knob for regulating a feed length, and 74 a top cover, as shown in FIG. 1.

Figure 4:
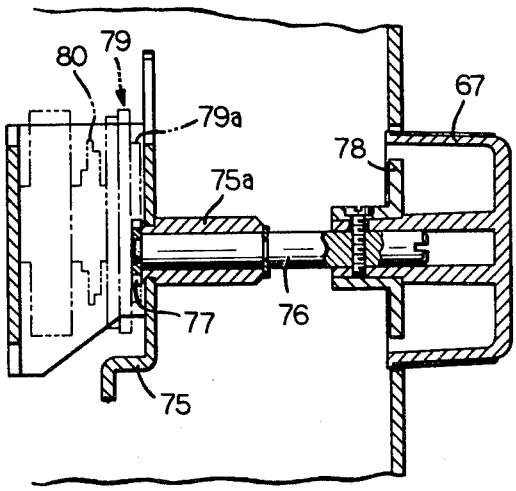
FIG. 4 is a partial sectional view of FIG. 2 taken along the line IV—IV.

With reference to FIGS. 2 and 4 description about pattern selecting means including the pattern selecting knob 67 is to be described. On a bearing sleeve 75*a* which is secured to a bracket 75 fixedly installed within the machine frame 1 an operated shaft 76 is rotatably carried by being fitted thereinto, on the inner end of the shaft 76 being fixed a small gear 77, and on the outer end of the shaft 76 are fixed the pattern selecting knob 67 and a cam 78, on which recesses 78*a* and protrusions 78*b* are alternatively arranged. On the switching arm 20 is secured an engagement pin 20*d* for confronting with the cam 78. On a not shown support shaft rotatably carried by the bracket 76 in parallel to the operated shaft 76, a lift cam 79 and a selector cam 80 are secured so that they may be integrally rotated with said support shaft together with some other regulating cams, and a gear portion 79*a* formed integrally with the lift cam 79 is meshed with the small gear 77; when the operated shaft 76 is rotated by the operation of the pattern selecting knob 67, the lift cam 79 and the selector cam 80 will be rotated in a reduced speed, and the position of a cam follower, which is to be abuttingly engaged with a well known pattern cam (not shown) driven in interlocking with the main shaft 2, can thereby be selectively changed. This cam selecting mechanism is well-known, requiring no further explanation. The details are disclosed in U.S. Pat. No. 4,063,525 by the same applicant as in the present application.

Figure 8:
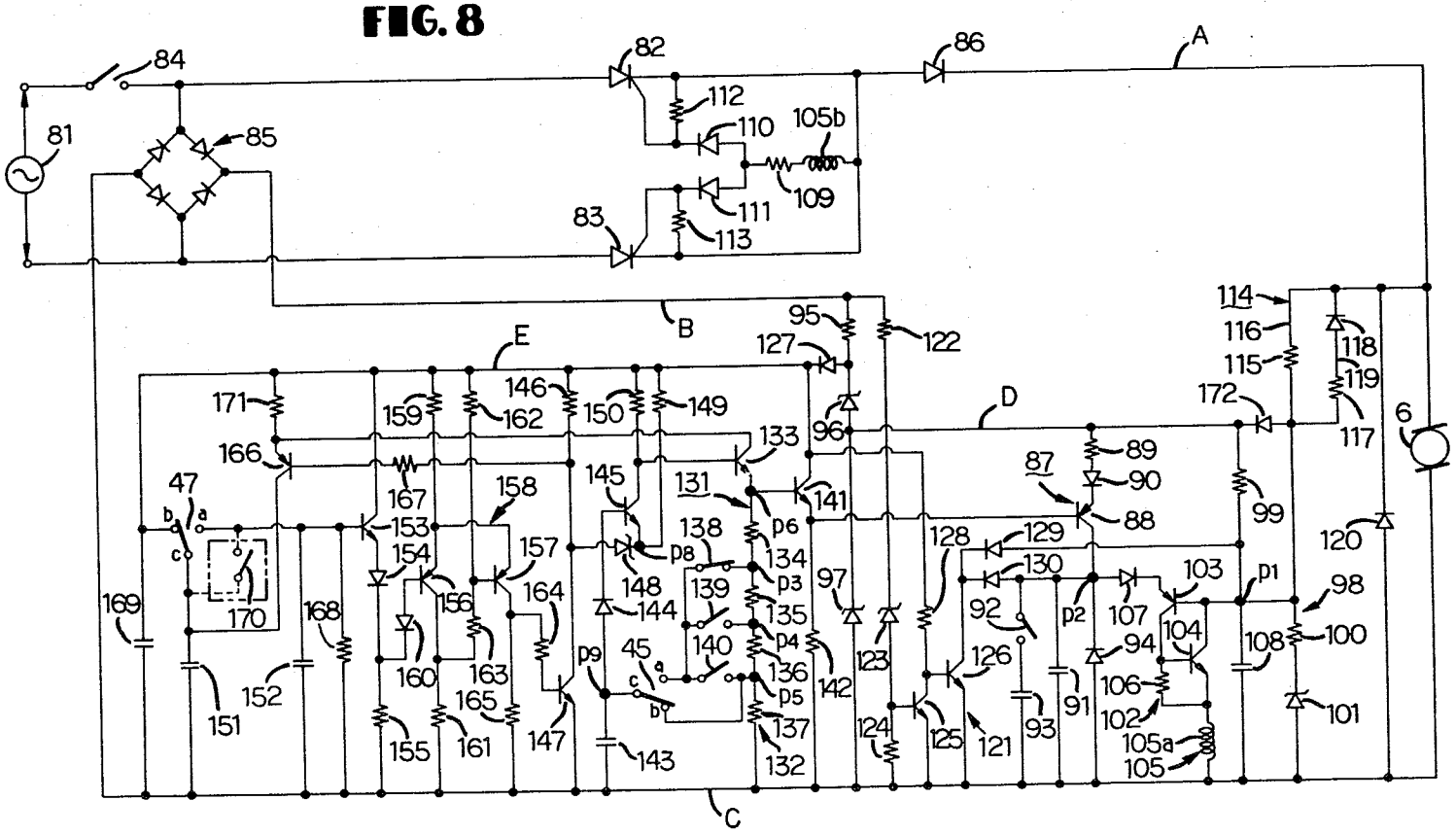
FIG. 8 is an electric circuit for explaining the driving control of a machine drive motor.

With reference to FIG. 8 construction of an electric circuit related to the above-mentioned mechanism is to be explained. Numeral 81 designates an AC voltage source, 82 and 83 designate respectively a thyristor for regulating the power supply to the drive motor 6. The anode of the thyristor 82 is connected, via a main switch 84 which is opened and closed by the operation of the push button 66, to one terminal of the AC voltage source and at the same time to an AC input terminal of a full wave rectifier circuit. The anode of the thyristor 83 is directly connected to the other terminal of the AC voltage source and at the same time to the other AC input terminal of the full wave rectifier circuit 85. The cathodes of the thyristors 82, 83 are respectively connected, via a common diode 86, to a DC bus line A. The DC output terminal on the positive side of the full wave rectifier circuit 85 is connected to a conductor B, and the DC output terminal on the negative side is connected to a common bus line C. Numeral 87 designates a trigger circuit for supplying the thyristor 82, 83 trigger pulses for regulating the conduction angle thyristor- ON phase range in the full wave rectified voltage of those thyristors; emitter of a transistor 88 which constitutes a part of the trigger circuit 87 is connected, via a resistor 89 and a diode 90, to an auxiliary bus line D, and collector of the transistor 88 is connected, via a timing capacitor 91, to the common bus line C. The capacitor 91, a series circuit of a switch 92 and a capacitor 93, and a diode 94 are respectively connected to the common bus line C in parallel. And the switch 92 is to be closed when the AC voltage source is at 50 Hz.

The conductor B is connected, via a resistor 95 and a pair of series connected Zener diodes 96, 97, to the common bus line C, to the anode side of one of the two Zener diodes, that is diode being connected the auxilliary bus line D. Numeral 98 designates a reference signal generating circuit for generating a reference signal corresponding to a predetermined rotational speed of the drive motor 6, which contains a DC circuit composed of resistors 99, 100 and a Zener diode 101. Numeral 102 designates a trigger pulse generating circuit for regulating the conduction of the thyristors 82, 83, including a PNP transistor 103, an NPN transistor 104, a primary coil 105*a* of a pulse transformer 105, and a resistor 106. The base of the transistor 103 is connected to the junction P1 of the resistors 99 and 100; and the emitter of the same is connected, via a diode 107, to the junction P2 of the collector of the transistor 88 and the capacitor 91. Numeral 108 designates a capacitor for absorbing high frequency. One end of the secondary coil 105*b* of the pulse transformer 105 is connected, via a resistor 109 and a diode 110 or 111, to each gate of the thyristor 82, 83; the other end of the same is connected to the cathode of both thyristors 82, 83. Numerals 112, 113 are respectively a respective connected between the gate and cathode of the thyristors 82, 83.

Numeral 114 designates a detector circuit for generating a speed signal which is in proportion to the rotational speed of the drive motor 6, being composed of a first branch 116 consisting in a resistor 115 connected between the DC bus line A and the junction P1 and a second branch 119 consisting of a series circuit of a resistor 117 and a diode 118 parallelly connected with the first branch 116. The the counter electromotive force developed by the drive motor 6, as the above-mentioned speed signal, is selectively supplied to both branches 116, 119. A flywheel diode 120 is parallelly connected with the drive motor 6. Numeral 121 designates a discharging circuit for completely discharging the timing capacitors 91 and 93 when the full wave rectified voltage impressed to the conductor B has reached substantially zero. In this circuit a series circuit of a resistor 122, a Zener diode 123, and a resistor 124 is connected between the conductor B and the common bus line C, and the anode of the Zener diode 123 is connected to the base of a transistor 125, the collector of which transistor 125 being connected to the base of another transistor 126, and the base of which transistor 126 being connected, via a resistor 128, to an auxiliary bus line E led from the cathode of the Zener diode 96 by way of a diode 127. The emitter of both transistors 125, 126 is respectively connected to the common bus line C, and the collector of the transistor 126 is connected to the junction P1 and the junction P2 respectively through a diode 129 and a diode 130.

Description will be proceeded to the circuit construction for controlling the trigger circuit 87. Numeral 131 designates a voltage generating circuit for generating a speed setting voltage corresponding to a desired speed of the drive motor 6, a group 132 of speed setting resistors which constitutes a part of the voltage generating circuit 131 being composed of resistors 134–137 connected in series between the emitter of a transistor 133 and the common bus line C. Each junction P3, P4 and P5 between each two neighboring resistors 134–137 is respectively connected to each contact of selector switches 138–140 which are closed in response to the depressing operation of the push buttons 65, 64, and 63 for selectively setting the rotation speed of the drive motor 6 at one of the high, middle, and low speeds, and each of the other contact of the three selector switches 138–140 is commonly connected to a contact a of the changeover switch 45. The emitter of the transistor 133 is connected to the base of a transistor 141 for supplying base current to the transistor 88, the collector of the transistor 141 being connected to the auxiliary bus line E and the emitter thereof to the common bus line C via a resistor 142. Contact b of the changeover switch 45 is connected to the junction P5 and common contact c of the same is connected, via a capacitor 143, to the common bus line C and also to the base of a transistor 145 by way of a diode 144. The collector of a transistor 147 which is connected, via a resistor 146, between the auxiliary bus line E and the common bus line C is connected, by way of a Zener diode 148, to the emitter of the transistor 145, the cathode of the Zener diode 148 being also connected to the auxiliary bus line E, by way of a resistor 149 for the purpose of giving a certain predetermined Zener voltage. The collector of the transistor 145 is connected, via a resistor 150, to the auxiliary bus line E and also to the base of the transistor 133 directly, the collector of the latter being connected to the auxiliary bus line E, via a resistor 171 of small resistance value.

Description now turns to the explanation of the circuit construction for controlling the starting and stopping of the machine. A capacitor 151 is connected, via the changeover switch 47, between the auxiliary bus line E and the common bus line C, another capacitor 152 being connected in parallel with the capacitor 151 via the changeover switch 47. Contact a of the changeover switch 47 is connected to the base of a transistor 153 whose collector is connected to the auxiliary bus line E. The emitter of the transistor 153 is connected, via a diode 154 and a resistor 155, to the common bus line C. A Schmitt trigger circuit 158 is composed of transistors 156, 157, the emitter of both are jointly connected via a resistor 159 to the auxiliary bus line E. The base of the transistor 156 is connected, via a diode 160, to the cathode of the diode 154, and the collector of the same is connected, via a resistor 161, to the common bus line C. The base of the transistor 157 is connected to the junction of a resistor 162 and a resistor 163 which constitute a series circuit with the resistor 161, and the collector of the same is connected, via a resistor 164, to the base of the transistor 147 and to the common bus line C by way of a resistor 165. Between the collector of the transistor 133 and the positive side of the capacitor 151 is connected another transistor 166, whose base is connected, via a resistor 167, to the anode of the Zener diode 148. Numeral 168 designates a resistor, 169 numeral designates a smoothing capacitor, and numeral 172 designates a diode for protecting a transistor. The switch 146 in FIG. 3 has nothing to do with this invention, so it is not shown in the electric circuit of FIG. 8.

OPERATION

FIGS. 1-3 and FIG. 8 illustrate a machine in a halting state, wherein the manually operable lever 34 is placed at the first position P1, with the changeover switches 45, 47 being all connected to the side of contact b. The switching arm 20 is maintained at a position where the machine is halted at the needleup position, after having been moved thereto due to the operation of the change lever 26 by the operated knob 27. The selector switch 138 is closed by the depressing operation of the push button 65 for high speed setting, with the other selector switches 139, 140 being open.

When the push button 66 is pressed a main switch 84 is closed to instantly charge the capacitor 151. In such a state the transistor 153 is kept OFF, so that the transistor 156 in the Schmitt trigger circuit 158 is kept ON, and the other transistor 157 OFF. Consequently the transistor 147 will be turned OFF and the transistor 133 ON due to a supplying of base current by way of the resistor 150. At this state the emitter voltage of the transistor 133, i.e., the voltage of a point P6 is to be determined by the potential dividing proportion between the group of resistors 132 for speed setting and a resistor 171, which keeps the transistor 141 ON and the transistor 88 in turn OFF. The trigger circuit 87 does not operate and the trigger pulse generating circuit 102 does not generate trigger pulses. The thyristors 82, 83 kept OFF will retain the drive motor 6 at halt.

Figure 7:
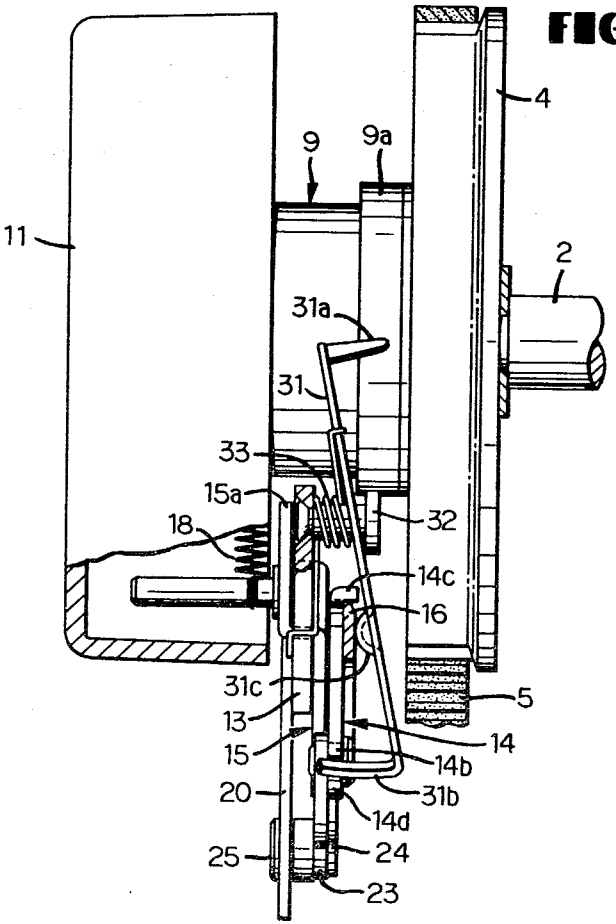
FIG. 7 is a projectional view, partially broken away, of a part of FIG. 5 seen from the line VII—VII.

If and when the manually operable lever 34 is rotated from the position P1 to the position P2 in FIG. 1, for running the machine, the switch lever 35 will be raised in FIG. 2 to cause on one hand the interlocking lever 16 to be counterclockwise rotated followingly, due to the action of the tension spring 36, accompanying a same directional rotation of the stop lever 14 through the engagement of the bent portion **14*c* with the interlocking lever 16, and on the other hand the switch actuating cam body 42 to be rotated, via the rod 39, the intermediate lever 37, the rod 40, rotatable lever 41, and the rod 44. The rotation of the stop lever 14 moves the abutment portion 14*a* out of the rotational locus of the engagement portion 9*a* of the rotatable member or sleeve 9, and moves the connection pin 25 upwards, via the link 23, along the vertical slot 20*b* of the switching arm 20, and at the same time rotates the other stop lever 15, via the link 24, clockwise from the position in FIG. 2, against the action of the tension spring 18. Rotation of the interlocking lever 16 makes the side surface thereof urge the semi-spherical portion 31*c* of the actuating lever 31; urging on the semi-spherical portion 31*c* will force the lever 31 itself to tilt against the action of the coil spring 32. The pawl portion 31*a* of the actuating lever 31, therefore, comes out of the annular groove 4*c* of the pulley 4, being rotated due to the action of the coil spring 32 to eventually abut the boss portion 9*a* of the sleeve 9 (see FIG. 7). In FIG. 5 the moved position of each member, in case the manually operable lever 34 has been moved to be retained at the second position P2, is respectively illustrated with solid lines. The interlocking lever 16 is retained at the illustrated position by the engagement of its bent portion 16*a* with the support plate 13**.

Due to the rotation of the switch actuating cam body 42, the changeover switches 45 and 47 are turned to the side of contact a, which impresses the charge of the capacitor 151 to the base of the transistor 153 for making the same ON. It results in turning one transistor 156 of the Schmitt trigger circuit 158 OFF, the other transistor 157 ON, and the transistor 147 ON. Turning of the transistor 147 to an ON state is accompanied by the turning of the transistor 166 to ON, which gives rise to an impress of the base voltage to the transistor 153, by way of the switch 47 changed to the side of contact a, for keeping the transistor 153 ON. The capacitors 151, 152 will be continuously charged, so long as the changeover switch 47 is kept on the side of contact a, to keep them at a voltage that depends on the resistors 171, 168. Turning of the transistor 147 to an ON state and changeover of the switch 45 to the side of contact a will cause an impressing of a voltage to the base of the transistor 145 higher than that at a point P8, i.e., a voltage almost as high as the voltage at the junction P3 in the group 132 of the speed setting resistors. The collector voltage of the transistor 145 will thereby take a value depending on the difference of voltage between the point P3 (junction) and the point P8. When the selector switch 139 for middle speed setting is closed, contrary to the above, the collector voltage of the transistor 145 will take a value depending on the difference of voltage between the point P4 and the point P8; and the collector voltage of the transistor 145 will, when the selector switch 140 for low speed setting is closed, take a value depending on the difference of voltage between the point P5 and the point P8. As the voltage of the points P3, P4, P5, situated in the group 123 of the speed setting resistors, is so graded as to progressively lower in the order, so the collector voltage of the transistor 145 is the lowest when the selector switch 138 is closed and the highest when the selector switch 140 is closed. The collector voltage of the transistor 145 in such a situation is impressed to the base of the transistor 133, so at the emitter of which, that is, at a point P6 a speed setting voltage is generated, which is to be the lower, as the set speed by the selector switches 138–140 the higher becomes. Impressing of this speed setting voltage to the base of the transistor 141 determines the emitter voltage of the same, which is in turn impressed to the base of the transistor 88. The collector current of the transistor 88 will take a value depending on the above-mentioned speed setting voltage, and charging of the timing capacitor 91 at every half cycle can be carried out very quickly when the selector switch 138 for high speed setting is in closing. The moment when the voltage at the junction P2 exceeds that of the junction P1, the transistors 103, 104 are almost simultaneously turned ON, which induces the trigger pulse generation at the secondary coil of the pulse transformer 105 for simultaneously triggering the thyristors 82, 83. Out of the two thyristors 82, 83, one, in which a voltage of positive direction is impressed between the anode and the cathode, will be conducted to supply the drive motor 6 electric power for rotating it. As stated above, by means of setting the collector current of the transistor 88 at a certain value in accordance with the selective closing of the selector switches 138–140, the conduction angle of the thyristors 82, 83 is substantially determined corresponding to the set value of the above-mentioned collector current, with a result of maintaining the speed of the drive motor 6 at a constant speed (revolutions per minute) corresponding the set value.

Although the drive motor 6 is generally likely to fluctuate in its r.p.m. during its operation due to the varying of the load, the exemplary tendency is skilfully prevented in this embodiment by means of disposing a speed sensing circuit 114, which guarantees a stable maintaining of an almost constant r.p.m. without greatly deviating from the predetermined r.p.m. irrespective of the varying of the load, by means of regulating the voltage at the junction P1. The detail of this mode of operation is not important for the understanding of this invention, so that it is omitted herein.

Upon the starting of the drive motor 6 the pulley 4 is rotated together with the shaft collar 3. Tightening close of the spiral spring 8 by rotating of the collar 3 will cause the main shaft 2 to drive. After having reached the normal driving the machine will be maintained at the high speed set by the push button 65. It will need no further explanation that the sleeve 9 and the spiral spring 8 are both rotated together with the main shaft 2 just like one body. The machine operated in this way can be adjusted, during its operation, to carry out a desired sewing at a desired amplitude and feeding by manipulating the first and second operating knobs 72, 73; a pressing operation of the other push button 63 or 64 during the progress of sewing will release the push button 65 accompanied by opening of the selector switch 138 and closing of the other selector switch 139 or 140. The thyristors 82, 83 will be narrowed in their conduction angle to drive the drive motor 6 at a corresponding lower r.p.m. (low or medium speed).

After having performed a desired sewing operation, the machine can be halted by moving the manually operable lever 34 from the second position P2 back to the first position P1, followed by restoring of the switch lever 35 and the switch actuating cam body 42. The restoration of the switch lever 35 will cause the interlocking lever 16 to clockwise rotate (in FIG. 5) and the stop lever 14 to slightly rotate, following after the interlocking lever 16, due to the action of the tension spring 18. It also causes the other stop lever 15 to slightly rotate by way of the links 23, 24. However, the stop levers 14, 15 are restrictive of further rotation because of abutment of the engagement portion **14*b* of the stop lever 14 with the bent portion 31*b* of the actuating lever 31. The rotation of the interlocking lever 16 will release the urging of the actuating lever 31 through the semi-spherical portion 31*b* to move the pawl portion 31*a* along the annular collar portion 9*a* of the sleeve 9 and the boss portion 4*a* of the pulley 4, and finally to fit into the initial end of the spiral groove 4*b***.

On the other hand, the restoration movement of the switch actuating cam body 42 makes the switches 45, 47 change to the side of contact b. The changeover of the switch 45 causes the capacitor 152 which has been charged until then to initiate discharging at a certain time constant which is determined by the resistors 168, 155, which discharging maintains the transistor 153 ON until the base voltage of the same becomes almost equal to its emitter voltage. The transistor 157 in the Schmitt trigger circuit 158 is therefore maintained ON for some time after the switch 47 has been changed over to the side of contact b to keep in turn the transistor 147 ON. Restoration of the switch 45 back to the side of contact b will generate a similar voltage at the point P9 as the voltage observed at the point P5 when the selector switch 140 is closed, irrespective of closing of the selector switch 138, which reduces the collector current of the transistor 88 because of the above-mentioned reason. The thyristors 82, 83 which are conducted at each half cycle with a narrow conduction angle will maintain the machine at a low speed rotation.

The pawl portion **31*a* of the actuating lever 31 is moved around, as the pulley 4 continues to rotate, under guidance of the spiral groove 4*b*, which causes the actuating lever 31 itself to be gradually rotated clockwise (in FIG. 5), against the action of the coil spring 33. As the bent portion 31*b* of the actuating lever 31 is released from the engagement with the engagement portion 14*b* of the stop lever 14, immediately before the pawl portion 31*a* of the actuating lever 31 is thrown out of the end of the spiral groove 46 to be fitted into the annular groove 4*c*, the stop lever 14 is rotated back due to the action of the tension spring 18, and the abutment portion 14*a* thereof comes into the rotational locus of the engagement portion 9*b* of the sleeve 9 (see the position shown by the dot-dot-dash line in FIG. 5). The other stop lever 15 is also rotated, due to the action of the tension spring 18, up to the illustrated position with the two-dot-chain lines in FIG. 5, via the links 23, 24, but the abutment portion 15*a* is located out of the rotational locus of the engagement portion 9*b* of the sleeve 9. Before the main shaft 2 rotates one round, after the stop lever 14 is rotated back, the engagement portion 9*b* abuts the abutment portion 14*a* to halt the sleeve 9, with a result of stopping the main shaft 2 when the take-up lever has reached the highest possible position. Then one end of the spiral spring 8 is halted to loosen the spring itself from the shaft collar 3, allowing the pulley 4 to idly rotate. The pawl portion 31*a* of the actuating lever 31 is to be fitted into the annular groove 4*c* of the pulley 4 after a short time later. Then the drive motor 6 will be halted by the following process. As the capacitor 152 discharges, the base voltage of the transistor 156 is exceeded by the emitter voltage; this results in turning the transistor 156 ON and the transistor 157 OFF. Consequently the transistor 147 becomes OFF, and the transistor 145 OFF. The transistor 88 in the trigger circuit 87 is turned OFF for the above detailed reasons. Stoppage of supplying of the trigger pulses to the thyristors 82, 83 will lead to interruption of power supplying to the drive motor 6**.

When the manually operable lever 34 is again turned to the second position P2 for resuming sewing operation, the machine will be put in running at a desired speed which has been selected by one of the push buttons 63–65; when the manually operable lever 34 is returned to the first position P1, the machine will be rotated a few rounds more at a low speed which is independent from the speed set by the push button, and then it is completely halted, with the take-up lever positioned at the highest point. As can be understood from the above description the actuating lever 31, the spiral groove **4*b*, etc., constitute a sort of mechanical delay mechanism for temporarily restraining the rotation movement of the stop levers 14, 15 owing to the tension spring 18; and the capacitor 152 and the Schmitt trigger circuit 158 have a function of supplying electric power to the drive motor 6 until the main shaft 2 completely stops at a predetermined position due to the delayed restoration of the stop levers 14, 15 irrespective of the rotating back of the manually operable lever 34 to the position P1, i.e., the machine halting position. Further, in the discharging circuit 121 the transistor 125 keeps its OFF state until full wave rectified voltage exceeding the voltage set by the Zener diode 123 appears on the conductor B; as the transistor 126 is kept in ON state in the meantime, residual charge of the timing capacitor 91, after the thyristors 82, 83 have been triggered, will be completely discharged, via the transistor 126, during a certain time wherein the voltage value in each half cycle of the AC source is in the neighborhood of zero, to prevent variation of the conduction angle of the thyristors 82, 83** due to accumulation of residual charge.

It is sometimes necessary to halt the machine operation during the running of a desired sewing at a state where the needle is penetrated through the work. Such a desire can be satisfied in this embodiment by the under-mentioned operation. When the operated knob 27 is so operated as the indicating line 27*a* agrees with the needle-down in the indicator 71, the change lever 26 will be rotated accompanied by a counterclockwise rotation of the switching arm 20 about the stepped pin 21. Rotation of the switching arm 20 makes the connection pin 25 fitted in the vertical slot 20*b* shift, which consequently moves the pair of the links 23, 24 connected to the pin 25. It eventually rotates the stop levers 14, 15 as under-mentioned. In the first half of the rotation of the switching arm 20, the connection pin 25, because of the stop lever 14 being biased clockwise by the action of the tension spring 18, is counterclockwise (in FIG. 2) rotated about the pivot point of the link 23 to the connecting portion 14*d* of the stop lever 14 in its stationary condition, together with the link 23 itself. Only the stop lever 15 is counterclockwise rotated (in FIG. 2), via the link 24, until it abuts the circumferential surface of the sleeve 9 to be blocked of its further rotation. In the second half of rotation of the switching arm 20, the connection pin 25 is rotated about the pivot point of the link 24 to the connecting portion 15*b* of the stop lever 15 which is in a stationary position, together with the link 24 itself. It causes the stop lever 14 to counterclockwise rotate (in FIG. 2) via the link 23 against the action of the tension spring 18, and further the abutment portion 14*a* to be thrown out of the rotational locus of the engagement portion 9*b* of the sleeve 9. The switching arm 20 oscillates, when it rotates, the connection plate 50 once (one round oscillation) through the fitting engagement of the pin 52 fixed on the lower end of the arm 20 into the cam slot 50*c* of the connection plate 50. The connection plate 50 rotates, in its forward movement, the actuating arm 49, against the action of the weak tension spring 53, counterclockwise (in FIG. 2), which urges temporarily at its actuating portion 49*a* the contacting lever of the switch 47 only and the urging on the contacting lever is released by the returning rotation of the actuating arm 49 caused by the returning rotation of the connection plate 50.

The above series of operations causes the switch 47 to be changed over to the side of the contact a temporarily, which results in impressing the charge of the capacitor 151 to the base of the transistor 153, followed by turning to ON of the transistor 153 and then of the transistor 147. The turning to ON of the transistor 147 turns, in turn, the transistor 166 to ON, which instantly and fully charges the capacitor 152, via the changeover switch 47 which has been converted to the side of the contact a. The transistor 153 is maintained at ON for a certain period of time, by the action of the capacitor 152, irrespective of the later returning of the switch 47 to the side of the contact b, and the transistor 147 is also maintained at ON for some more time. Due to the turning to ON of the transistor 147 and the changeover switch 45 kept on the side of the contact b, a high speed setting voltage, similar to that when the selector switch 140 for low speed setting is closed, is generated, as clearly understood from the above, at the point P6 in the voltage generating circuit 131, irrespective of the closed condition of the selector switches 138–140, and the thyristors 82, 83 are alternatively conducted at a narrow conduction angle, by the action of the trigger circuit 87 and the trigger pulse generating circuit 102, for driving the drive motor 6 temporarily at a low speed.

Owing to the needle-down selective operation of the change lever 26, the stop lever 14 which has been engaged with engagement portion 9*b* of the sleeve 9 gets out of the engagement portion 9*b* to be moved away from the rotational locus of the same, and the abutment portion 15*a* of the stop lever 15 gets into the rotational locus of the engagement portion 9*b*, prior to the above-mentioned movement of the stop lever 14. During this shifting movement of the two stop levers 14, 15 the drive motor 6 is initiated to drive. The main shaft 2 is thus initiated to rotate at a low speed together with the sleeve or rotatable member 9, and is halted later when the engagement portion 9*b* abuts the abutment portion 15*a* of the stop lever 15, that is, when the needle penetrated through the work has reached the substantially lowest position. Then the power supply to the drive motor 6 is interrupted. This needle-down halting state, so to speak, is very favorable in preventing the moving or slipping of the work during the preparation for the further sewing after lifting of the pressure foot. At this time turning of the operating knob 27 serves to make the switching arm 20 counterclockwise rotated and stably retained in a state wherein the stud portion of the stepped screw 22 is closely contacted to the left edge of the slot 20*a* with the aid of the tension spring 28.

When the manually operable lever 34 is operated to move, with the change lever 26 being set at the needle-down position, from the first position P1 to the second position P2, the machine is put in operation for new sewing; when the lever 34 is again operated to move back, after having finished a desired sewing, from the second position P2 to the first position P1, the machine can be halted, with the needle having reached almost the lowest possible point. As for the above-mentioned mode of operation, what is concerned with the action of the electric circuits is just the same as described in respect of the needle-up selection case, so only the rest is to be described with reference to FIG. 10. Rotational movement of the manually operable lever 34 from the first position P1 to the second position P2 moves the switch lever 35 from the position illustrated with solid lines to the dot-dot-dash line illustrated position, followed by a tracing rotation of the interlocking lever 16, due to the action of the tension spring 36, until the bent portion 16*a* abuts the support plate 13. Due to the rotation of the interlocking lever 16, the stop lever 14 is on one hand rotated, by the abutment of the bent portion 14*c* on the lever 16, from the solid line position to the two-dot-chain line position, and the stop lever 15 is also rotated, owing to a movement of the pair of links 23, 24 and that of the connection pin 25, along the vertical slot 20*b*, to the two-dot-chain line position, with a result of throw-out of the abutment portion 15*a* of the stop lever 15 off from the rotational locus of the engagement portion 9*b* of the sleeve 9. On the other hand, rotation of the interlocking lever 16 urges at its one surface the semi-spherical portion 31*b* of the actuating lever 31, so the lever 31 is moved to take a position shown in FIGS. 5 and 7, similarly to the case afore-mentioned. When the machine is halted, after having performed a desired sewing operation, by a manipulation of the manually operable lever 34, the switch lever 35 and the interlocking lever 16 are instantly restored to the position illustrated in FIG. 10 with the solid lines; but the stop levers 14, 15 can not be returned to the original position immediately, because of the mechanical delay mechanism composed of the actuating lever 31 and the spiral groove 4*b*, etc., for allowing the main shaft 2 to rotate some more time at a low speed. When the bent portion 31*b* of the actuating lever 31 gets out of the engagement portion 14*b* of the stop lever 14, the two stop levers 14, 15 are rotated back due to the action of the tension spring 18, in a mutual close relation, with a result that the abutment portion 15*a* of the stop lever 15 gets into the rotational locus of the engagement portion 9*b* of the sleeve 9, and the abutment portion 15*a* abuts the circumferential surface of the sleeve 9 to block the rotation of the stop lever 15. The stop lever 14 is also blocked of its further clockwise rotation from the position shown in FIG. 10 with solid lines, with the abutment portion 14*a* being located out of the rotational locus of the engagement portion 9*b*. Within one round of the main shaft 2 after the abutment portion 15*a* of the stop lever 15 has got into the rotational locus of the engagement portion 9*b* of the sleeve 9, the engagement portion 9*b* will then abut the abutment portion 15*a* to stop the rotation of the main shaft 2 and lead the pulley 4 to an idle rotation. Soon after the power supply to the drive motor 6 is interrupted to halt the pulley 4. Thus the needle is positioned at a position substantially the lowest possible point when the main shaft 2 is stopped.

When the machine is put in operation again, after it has been once halted, for another sewing by turning the manually operable lever 34 to the second position P2, the above-mentioned operation will be repeated. The machine is operated at a selected speed by the push buttons 63–65; when the manually operable lever 34 is turned back to the first position P1, the machine is run at a low speed for some time which is independent from the speed selected by the push button, before it is stopped at a state wherein the needle has reached the lowest possible position.

When it is necessitated to lift the needle for removing the work out of the place etc., only an upward rotation of the change lever 26 by the operated knob 27 is needed. The switching arm 20 will be, contrary to the above-mentioned case, clockwise rotated to shift the stop levers 14, 15 in mutual relation, via the connection pin 25, which is fitted in the vertical slot 20*b*, and the pair of links 23, 24, from the position illustrated with solid lines in FIG. 10 to the position in FIG. 2. That is to say, in the first half of the rotation of the switching arm 20, the connection pin 25 revolves clockwise in FIG. 10 around the pivot point of the link 24 to the connecting portion 15*b* of the stop lever 15 in a stationary state, together with the link 24, and only the stop lever 14 is rotated clockwise in FIG. 10, via the link 23, the abutment portion 14*a* of which lever 14 being abutted the circumferential surface of the sleeve 9 to retain further rotation of the sleeve 9. In the second half of rotation of the switching arm 20, the connection pin 25 revolves around the pivot point of the link 23 to the connecting portion 14*d* of the stop lever 14 in a stationary state, together with the link 23, and only the stop lever 15 is rotated clockwise, against the action of the tension spring 18, the abutment portion 15*a* of which lever 15 being moved to a position out of the rotational locus of the engagement portion 9*b* of the sleeve 9. Besides, rotation of the switching arm 20 oscillates the connection plate 50 once, and the actuating arm 49 makes the changeover switch 47 temporarily operate, with a result of actuating the drive motor 6 for a short while at a low speed. The main shaft 2 rotates together with the sleeve 9 at a low speed, and when the engagement portion 9*b* abuts the abutment portion 14*a* of the stop lever, i.e., when the take-up lever has reached almost the highest possible position, the rotation of the main shaft 2 is stopped.

To sum up, this embodiment is provided with a pair of stop levers 14, 15 which can be abutted to an engagement portion 9*b* of a rotatable member or sleeve 9, which rotates together with the main shaft 2, at a pair of angularly different positions of the main shaft 2, which levers being normally biased by a tension spring 18 so as to get into the rotational locus of the engagement portion 9*b*, and a switching means including a change lever 26, a switching arm 20, a pair of links 23, 24, etc. The switching means allows by its selective operation only one of the stop levers 14, 15 to get into the rotational locus of the engagement portion 9*b*; when the machine is running, however, both of the stop levers are thrown out of the rotational locus of the engagement portion 9*b* by the action of an interlocking means consisting of switch lever 35, an interlocking lever 16, etc. When a manually operable lever 34 is operated for halting the machine, one of the stop levers 14, 15 selected by the switching means will be restored onto the rotational locus by the action of the tension spring 18 to stop the main shaft 2 at one of the pair of angularly different positions. The main shaft 2 stopped at one of the positions can be temporarily driven, by a selective operation of the switching means to the other position, to be eventually stopped at the other angular position.

Figure 9:
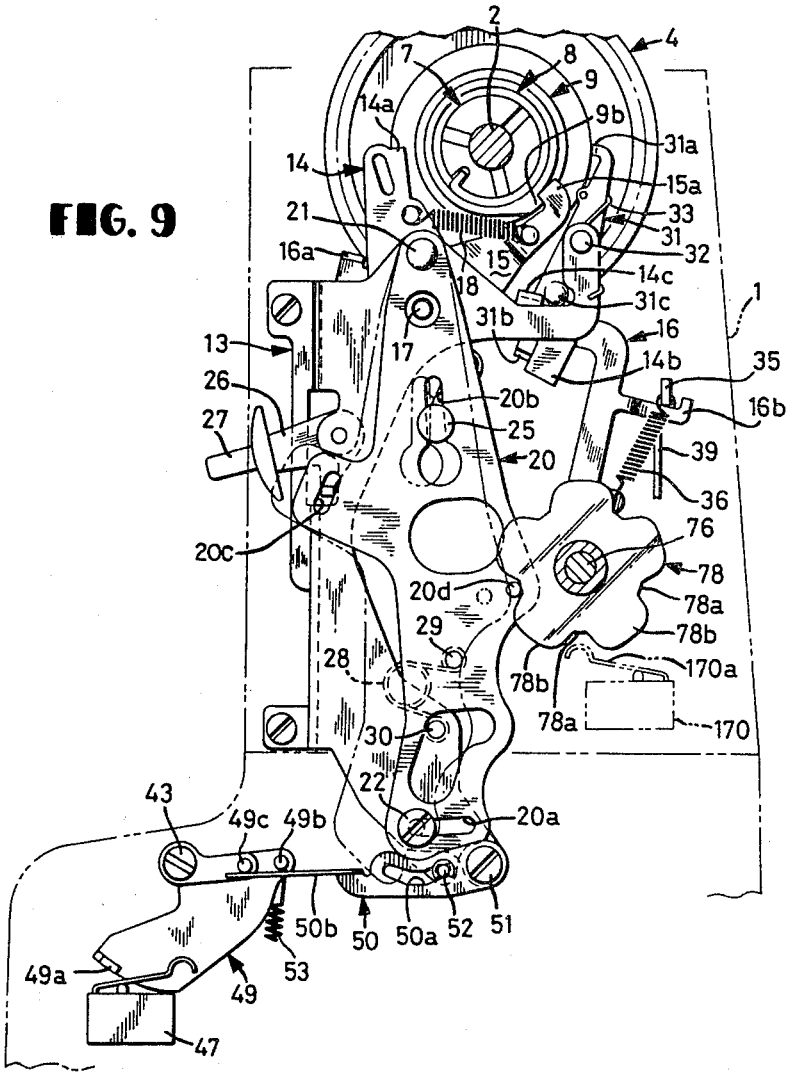
FIG. 9 is an elevation showing another operational mode of the embodiment shown in FIG. 2.
Figure 10:
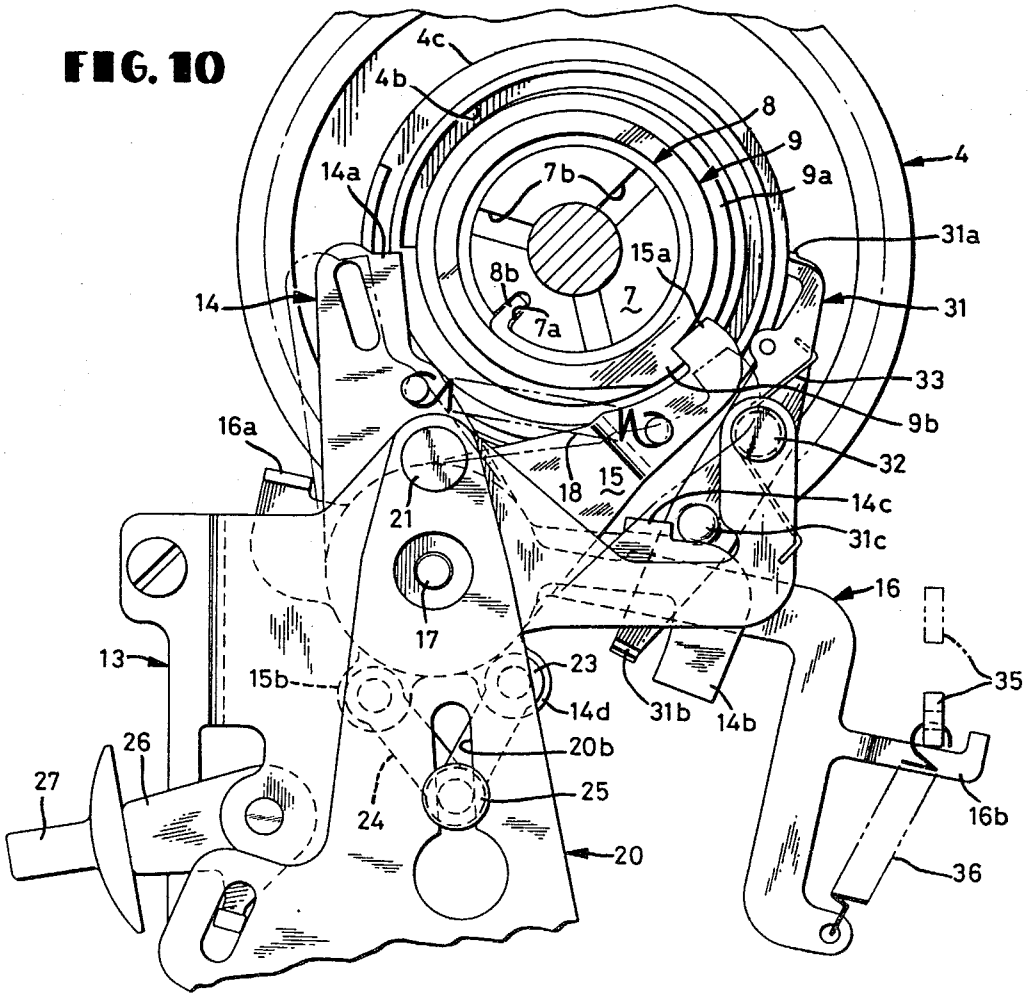
FIG. 10 is a partially enlarged elevation of FIG. 9.

At the needle-down halting position of the machine, which is shown in FIGS. 9 and 10 and also described above, a rotational operation of the pattern selecting knob 67, for selecting a different stitch pattern from that has hitherto been formed, will rotate again the main shaft 2 slightly until it reaches the needle-up position before it is stopped. With reference to FIGS. 4 and 9 this delicate mode of operation is to be described hereunder. The cam 78 fixed together with the pattern selecting knob 67 on the operated shaft 76 is so positioned, when a desired stitch pattern has been selected, as to be confronted at its recess 78*a* to the engagement pin 20*d* of the switching arm 20. So the shifting of the switching arm 20, due to the rotation of the change lever 26 executed through the operation of the knob 27, can be done without any interference with the cam 78, and the engagement pin 20*d* is situated, when the needle-down is being selected, in the recess 78*a* of the cam 78. As the gear ratio between the small gear 77 fixed on the operated shaft 76 and the gear portion 79*a* of the lift cam 79 integrally rotatable with the selector cam 80 is set at 1:3, the lift cam 79 and the selector cam 80 are, when the operated shaft 76 is rotated, driven at a reduced speed. If and when the pattern selecting knob 67 is rotated, for the purpose of selecting another stitch pattern in the state shown in FIG. 9, a sloped surface extending from the recess 78*a* to the protrusion 78*b* urgingly contacts the engagement pin 20*d* to forcibly rotate the switching arm 20 clockwise from the solid line position in FIG. 9, against the action of the coil spring 28. When the axis of the pin 29 fixed on the switching arm 20 is shifted leftwards beyond the imaginary line connecting the axis of the stepped pin 21 and that of the pin 30, the action of the coil spring 28 is reversed its direction to bring the switching arm 20 to the dot-dot-dash line position in FIG. 9. And the change lever 26 and the operated knob 27 are also rotated following after the switching arm 20 until they reach the position in FIG. 2. Such a rotation of the switching arm 20 plays an entirely the same operation as in the case of switching operation of the operated knob 27 from needle-down to needle-up; the stop lever 14 which has been out of the rotational locus of the engagement portion 9*b* of the sleeve 9 is moved to get, replacing the stop lever 15, to the rotational locus; the drive motor 6 is temporarily supplied with electric power due to a temporary changeover of the switch 47 to motivate the main shaft 2 for lifting the needle from the lower dead point upwards; and the main shaft 2 is stopped when the take-up lever has reached the highest possible point substantially. The re-rotation and stopping of the main shaft 2 is carried out instantaneously in relation to the shifting of the switching arm 20 in the initial stage of rotation of the pattern selecting knob 67; in the meantime the lift cam 79 and the selector cam 80 are slightly rotated, without substantially producing any pattern selecting operation. A later rotation of the pattern selecting knob 67 actuates the lift cam 79 to get a cam follower (not shown) out of the group of the pattern selecting cams and an ensuing operation of the selector cam 80 shifts the cam follower for completing the pattern selecting operation. During this period the engagement pin 20*d* is situated outside the protrusion 78*b* of the cam 78 never to come into an engagement with the cam 78. If the rotational operation of the pattern selecting knob 67 is stopped just when the pointer 70 (see FIG. 1) comes to coincidence with the display of the desired stitch pattern, the cam 78 will be positioned at a place wherein the recess 78*a* thereof is confronted with the engagement pin 20*d* to be retained there. It will not, therefore, interfere with the rotation of the switching arm 20 due to a later operation of the operated knob 27.

As can be understood clearly from the above description, the needle is instantly lifted upwards, even if the pattern selecting operation is carried out, with the main shaft 2 being stopped at the needle-down position, in relation to the initiation of the pattern selecting, to be stopped at a predetermined position free above the work. Substantial pattern selection is carried out therelater, so it never occurs, as in the conventional zigzag sewing machine, that the pattern selection is carried out, with the needle being penetrated through the work. This guarantees that the work will not be damaged by a lateral jogging motion of the needle. During the pattern selecting operation, with the needle being halted at the needle-up position, the switching arm 20 is not shifted just as in the conventional sewing machines.

In the above embodiment a needle positioning means is employed, by way of a changeover mechanism including a switching arm 20 for stopping the main shaft 2 at needle-up or needle-down position, whereby the main shaft 2 is driven from the needle-down position to the needle-up position before being stopped. Therefore, so long as the switching arm 20 is positioned at the needle-down selection position, shown with solid lines in FIG. 9, it is forcibly shifted, when the stitch pattern selection is initiated, to the position illustrated with two-dot-chain lines in the same figure, i.e., the needle-up position. The needle in penetration through the work is instantly lifted up above the work to a predetermined position. In case the switching arm 20 being at the needle-up selection position, there is no fear of any trouble occurring in the pattern selection, because the needle is generally positioned above the work when the machine is in a halted state.

In a case wherein the machine is halted, with the switching arm 20 being maintained at the needle-up position (see FIG. 2), and consequently the main shaft 2 is stopped with the needle being above the work, assume the machine operator has manually driven the main shaft 2 with the handwheel 11 until the needle comes in penetration through the work, a rotational operation of the pattern selecting knob 67 at this state will cause a pattern selecting operation, with the needle being in penetration through the work, without inviting any operation of the switching arm 20, which would certainly damage the work. Only addition of an on-off switch 170 to the above embodiment will be sufficient for eliminating this sort of problem. A contacting lever 170*a* attached to the on-off switch 170 disposed as shown in FIG. 9 will do a closing operation by being urged by the protrusion 78*b* of the rotated cam 78; when the pattern selecting knob 67 is not in operation the contacting lever 170*a* is, on the contrary, confronted with the recess portion 78*a* of the cam 78 to maintain the ON state. This on-off switch 170 should be connected, as shown in FIG. 8, between the positive side of the capacitor 151 and the base of the transistor 153. Disposition and connection of such an on-off switch 170 will eliminate the above stated rare problem in the following manner: When the pattern selecting knob 67 is turned, the closing of the on-off switch 170 causes the drive motor 6 to be supplied with electric power to actuate the main shaft 2, and the stop lever 14 for stopping the main shaft 2 at the needle-up position is in the operational position.

Every time when the protrusion 78*b* of the cam 78 urges the contacting lever 170*a* of the on-off switch 170, the same is opened and closed accordingly, which causes unnecessary driving of the drive motor 6; the rotation of the drive motor 6 will not incur any trouble or hindrance, because the connection of the pulley 4 and the main shaft 2 is interrupted by the action of the coil spring 8 as a clutch spring, after the main shaft once has been stopped at the needle-up position.

By further disposition of a needle position sensing switch which opens when the needle has reached a predetermined position above the work, and connection of the needle position sensing switch in series with the on-off switch 170, the unnecessary driving of the drive motor 6 can be prevented even when the on-off switch 170 is closed after the main shaft 2 has been stopped at the needle-up position.

It can be easily understood from the above description that the needle positioning means requires, in case of disposing an on-off switch 170 as in this embodiment, only one condition of stopping the main shaft when the needle has reached a predetermined position above the work, and does not need to have a by-function of stopping the main shaft at a second predetermined position where the needle penetrates through the work. It is also obvious that when the on-off switch 170 is so disposed, a member operatively connecting the switching arm 20 and the changeover switch 47, such as the actuating arm 49, the connection plate 50, etc., becomes needles. It is also possible to employ an electric positioning means as is well-known, instead of a mechanical positioning means in this embodiment, as a means for stopping the main shaft at a predetermined position. Furthermore, a well-known foot controller is replaceable for the structure of the drive regulating mechanism in this embodiment wherein most of the drive control circuits are accommodated within the machine frame and the manually operable lever 34 is installed on the front side of the machine frame for regulating the former. In this case the machine can be freely controlled of its driving, halting, and driving speed by depressing, releasing, and adjusting degree of depression of the foot controller, just similarly to the conventional sewing machines.

To sum up the characteristics of this invention herewith, in order to make the above description further impressive. A needle positioning means for stopping the main shaft with the needle situated at the upper predetermined position, normally operating upon the halting operation of a manually operable member for controlling the running and halting of the machine, and a manually operable pattern selecting means for selecting in advance one desired stitch pattern from among a plurality of stitch patterns formable during the sewing operation, are operatively interconnected by way of a connecting means, with the object of actuating the needle positioning means, when the pattern selecting means is operated, with the needle being in penetration through the work, in relation to the pattern selecting operation independent from the manually operable member, whereby the main shaft is rotated instantaneously to lift the needle out of the work up to a predetermined stop position; a substantial stitch pattern selection due to a later operation of the pattern selecting means is executed without fail at the state of the needle-up, consequently preventing the work damage by the lateral jogging of the needle in a work-penetrated condition. Furthermore, because a substantial pattern selecting operation is executed after the work-penetrated-needle has been lifted up out of the work owing to the single operation of pattern selecting means, the machine operator is liberated from the troublesome stepped way of conventional machine operation, wherein the operator has to ascertain if the needle is lifted up above the work by slightly driving the pattern selecting means before beginning a full-scale pattern selecting operation.

The machine in accordance with this invention employs, as a needle positioning means, a device which is capable of halting the main shaft not only at a first position where the needle is up but also at a second position where the needle is in penetration through the work, and a switching means operatively connected to the needle positioning means makes it possible to select, by a manual operation thereof in advance of the machine operation, either the first needle-up position or the second needle-down and work-penetrated position. Even when the pattern selecting means is operated, with the needle being in penetration through the work, the needle positioning means is automatically operated independently from the manually operable member to stop the main shaft within one round of itself at the first predetermined position. Therefore, even when the main shaft is stopped at the second position by a selective operation of the switching means, the needle does not laterally jog in a work-penetrated state.

When the pattern selecting means is operated while the main shaft is at the second predetermined position, it forcibly actuates the switching means in relation to the pattern selecting operation to alter the posture, accompanied by an immediate moving of the main shaft of the machine from the second predetermined position for stopping at the first predetermined position, because the pattern selecting means is, in this invention, connected to the needle positioning means via the switching means. This invention has thus succeeded in providing a noval and practical sewing machine which can be economically manufactured by only adding and changing a few members such as a cam for connecting the pattern selecting means with the needle positioning means.

What is claimed is:

1. A zigzag sewing machine comprising:

a frame;

a needle bar carrying a needle and mounted on said frame for lateral oscillation and endwise reciprocation;

a main shaft rotatably mounted on said frame to actuate said needle bar for the endwise reciprocation;

an electric motor for driving said main shaft;

a motor driving circuit for supplying electrical power to said electric motor;

a manually operable member for actuating said motor driving circuit to control running and stopping of the machine;

pattern selecting means manually operated prior to the running of the machine and for selecting any one of a plurality of stitch patterns which are formed by a variety of the lateral oscillation of said needle bar;

needle positioning means operative for stopping said main shaft at a predetermined position in which said needle is in the up position; and connection means operatively connecting said pattern selecting means with said needle positioning means for actuating the latter in relation to the initial operation of said pattern selecting means with said needle in the down position, whereby the substantial pattern selection is always effected with said needle in the up position.

2. A zigzag sewing machine according to claim 1, wherein said connecting means includes a cam body operated by the manual operation of said pattern selecting means to actuate said needle positioning means.

3. A zigzag sewing machine according to claim 1, wherein said connecting means is adapted not to actuate said needle positioning means regardless of the manual operation of said pattern selecting means with said main shaft in the predetermined position.

4. A zigzag sewing machine comprising:

a frame;

a needle bar carrying a needle and mounted on said frame for lateral oscillation and endwise reciprocation;

a main shaft rotatably mounted on said frame to actuate said needle bar for the endwise reciprocation;

an electric motor for driving said main shaft;

a motor driving circuit for supplying electrical power to said electric motor;

a manually operable member for actuating said motor driving circuit to control running and stopping of the machine;

pattern selecting means manually operated prior to the running of the machine and for selecting any one of a plurality of stitch patterns which are formed by a variety of the lateral oscillation of said needle bar;

needle positioning means for stopping said main shaft at a first predetermined position in which said needle is in the up position and at a second predetermined position in which said needle is in the down position;

switching means manually operable for selecting the stop position of said main shaft;

said needle positioning means being adapted to actuate in response to the operation of said manually operable member for stopping the machine; and connection means operatively connecting said pattern selecting means with said needle positioning means for actuating the latter independently of the operation of said manually operable member, in relation to the initial operation of said pattern selecting means with said main shaft in the second position, to move said main shaft from the second position to the first position, whereby the substantial pattern selection is always effected with the needle in the up position.

5. A zigzag sewing machine according to claim 4, wherein said needle positioning means includes a pair of stop levers each of which is engageable with said main shaft at a different angular position thereof for stopping said main shaft at each of the predetermined positions, and said switching means includes a switching arm which is movable to selectively render either one of said stop levers effective.

6. A zigzag sewing machine comprising:

a frame;

a needle bar carrying a needle and mounted on said frame for lateral oscillation and endwise reciprocation;

a main shaft rotatably mounted on said frame to actuate said needle bar for the endwise reciprocation;

an electric motor for driving said main shaft;

a motor driving circuit for supplying electrical power to said electric motor;

a manually operable member for actuating said motor driving circuit to control running and stopping of the machine;

pattern selecting means manually operated prior to the running of the machine and for selecting any one of a plurality of stitch patterns which are formed by a variety of the lateral oscillation of said needle bar;

needle positioning means for stopping said main shaft at a first predetermined position in which said needle is in the up position and at a second predetermined position in which said needle is in the down position;

switching means operatively connected with said needle positioning means, and manually operable for actuating said needle positioning means to stop said main shaft selectively at either the first position or the second position, and then to move said main shaft from one of the predetermined positions to the other; and connection means operatively connecting said pattern selecting means through said switching means for actuating said needle positioning means, in relation to the initial operation of said pattern selecting means with said main shaft in the second position, to move said main shaft from the second position to the first position, whereby the substantial pattern selection is always effected with the needle in the up position.

7. A zigzag sewing machine according to claim 6, wherein said connection means includes a cam body operated by the manual operation of said pattern selecting means to operate said switching means for actuating said needle positioning means.

8. A zigzag sewing machine according to claim 6, wherein said needle positioning means includes a pair of stop levers each of which is engageable with said main shaft at a different angular position thereof for stopping said main shaft at each of the predetermined positions, and a low-speed drive means disposed in said motor driving circuit for driving said main shaft at a low speed, and wherein said switching means includes a switching arm which is movable to selectively render either one of said stop levers effective and to actuate said low-speed drive means.

9. A zigzag sewing machine according to claim 8, wherein said low-speed drive means includes a switch, and said switching arm actuates said switch by means of the movement of said switching arm upon the manual operation of said pattern selecting means.

10. A zigzag sewing machine according to claim 8, wherein said connecting means includes a cam body operated by the manual operation of said pattern selecting means and engageable with said switching arm to move the latter.

11. A zigzag sewing machine according to claim 1, wherein said connecting means includes a electric switch operated by the manual operation of said pattern selecting means for rendering said motor driving circuit effective to rotate said main shaft before stopped at said predetermined position by said needle positioning means.

* * * * *